United States Patent [19]

Kuroyone

[11] Patent Number: 4,907,480

[45] Date of Patent: Mar. 13, 1990

[54] TURRET PUNCH PRESS MACHINE

[75] Inventor: Kazuo Kuroyone, Yamato, Japan

[73] Assignee: Anritsu Corporation, Tokyo, Japan

[21] Appl. No.: 138,712

[22] Filed: Dec. 24, 1987

[30] Foreign Application Priority Data

| | | | |
|---|---|---|---|
| Dec. 26, 1986 | [JP] | Japan | 61-308560 |
| Dec. 27, 1986 | [JP] | Japan | 61-309211 |
| Dec. 27, 1986 | [JP] | Japan | 61-309212 |
| Dec. 27, 1986 | [JP] | Japan | 61-309213 |

[51] Int. Cl.[4] ..... B21D 28/26; B21D 28/36

[52] U.S. Cl. ..... 83/552; 83/571; 83/859; 72/455

[58] Field of Search ..... 83/552, 549, 553, 641, 83/640, 618, 561, 571, 685, 556, 859; 72/455, 420; 408/35

[56] References Cited

U.S. PATENT DOCUMENTS

| | | | |
|---|---|---|---|
| 2,296,051 | 9/1942 | Pocock et al. . | |
| 2,309,998 | 2/1943 | Tucker | 83/552 |
| 3,049,038 | 8/1962 | Friedland | 83/552 |
| 3,418,923 | 12/1968 | Zeitlin et al. | 72/455 X |
| 3,561,252 | 2/1971 | Norton et al. | 72/455 |
| 3,777,543 | 12/1973 | Kokkola et al. | 72/455 X |
| 3,882,746 | 5/1975 | Daniels | 83/552 |
| 3,991,602 | 11/1976 | Harcuba et al. | 72/455 |
| 4,412,469 | 11/1983 | Hirata et al. | 83/552 |
| 4,532,845 | 8/1985 | Jinnouchi | 83/552 |
| 4,589,317 | 5/1986 | Kawano | 83/552 |
| 4,719,830 | 1/1988 | Kawada et al. | 83/552 |

FOREIGN PATENT DOCUMENTS 3137799 4/1983 Fed. Rep. of Germany .

*Primary Examiner*—Douglas D. Watts
*Assistant Examiner*—Rinaldi Rada
*Attorney, Agent, or Firm*—Frishauf, Holtz, Goodman & Woodward

[57] ABSTRACT

A turret punch press machine comprising a frame consisting of a base frame portion, column portions extending from the base frame portion, and an upper frame portion horizontally extending from the column portions. The upper frame portion is divided into first and second upper frame portions, a hammer and a hammer driving mechanism are attached to the first upper frame portion. An upper turret of paired ones, each having plural die halves at the circumferential rim portion thereof, is attached to the second upper frame portion, whereas another lower turret is attached to the base frame portion. Even when the first upper frame portion is deformed by the repulsive force and the like of the hammer which is being operated, the second upper frame portion is left undeformed so that the upper and lower turrets cannot have an undesired positional relationship.

11 Claims, 9 Drawing Sheets

TURRET PUNCH PRESS MACHINE

BACKGROUND OF THE INVENTION

1. Field of the Invention

The present invention relates to a turret punch press machine having a pair of turrets on which plural dies are mounted, and more particularly, to a turret punch press machine capable of preventing the paired turrets from being shifted from each other when their frames are deformed.

2. Prior Art

Various kinds of the turret punch press machines have been proposed these days and they can be classified into those of C-shaped frame type and those of gate-shaped frame type.

The conventional turret punch press machine of the C-shaped frame type is arranged as shown in FIG. 1. Numeral 10*a* represents a frame, which comprises a base frame portion 12*a*, a column portion 14*a* and an upper frame portion 16*a* and which is shaped in the form of letter "C". A hammer 18 is arranged at the front end of the upper frame portion 16*a* and driven by a hammer driving mechanism 20. This machine is also provided with a pair of turrets 22 and 24. The upper turret 22 is freely rotatably attached to the upper frame portion 16*a* by means of a shaft 34, whereas the lower turret 24 is rotatably attached to the base (or lower) frame portion 12*a* by means of a shaft 36. These turrets have plural dies at the circumferential rim portion thereof. Each of these dies consists of upper and lower halves 26 and 28. A work 30 is inserted between the upper and lower halves of dies on the turrets by means of a work movement positioning mechanism 32. The turrets are rotated, the halves of a selected die are positioned under the hammer, and then the hammer is pushed down and the upper half 26 is pressed, thereby punch-processing the work 30.

The pressing force applied on the hammer 18 amounts to 20–50 tons. The upper frame portion 16*a* is thus deformed, as shown in FIG. 1 (where the deformation is exaggerated), by the repulsive force of the hammer 18 which is being operated. As the result, the upper and lower turrets 22 and 24 are shifted from each other, and the upper and lower halves 26 and 28 come to have an undesired positional relationship. The work 30, thus, comes to have burrs and other deformation at its punched portion, thereby reducing processing accuracy and shortening the lifetime of the dies. The deformation of the frame is caused in the horizontal direction as well as in the vertical direction. It is also caused by heat created by the hammer driving mechanism and the aging change of the frame, as well as the repulsive force of the hammer. This frame deformation causes the positional accuracy of the upper and lower halves to become wrong, thereby decreasing the processing accuracy and the lifetime of the dies.

The conventional turret punch press machine of the gate-shaped type is schematically shown in FIG. 2. It is provided with a frame 10*b* comprising a lower frame portion 12*b*, a pair of column portions 14*b* and an upper frame portion 16*b*, and it has the same arrangement except for the frame as that in the press machine shown in FIG. 1. Even in the case of this press machine of the gate-shaped frame type, the frame is deformed, as shown in FIG. 2 (where the deformation is also exaggerated), by the repulsive force of the hammer and the like. Consequently, the upper and lower halves come out of order in their positional relationship. The turret punch press machine of this type is disclosed in U.S. Pat. No. 4,412,469 to Hirata et al. This device is fundamentally the same in arrangement as that shown in FIG. 2 and the positional relationship of the die halves is also made wrong because of the frame deformation.

The above-mentioned disadvantages caused by the frame deformation are more prominent as the machine becomes larger in size and the processing accuracy required becomes higher on a thin work piece. In order to compensate the aging deformation of the frame caused by various causes, the conventional large-sized and high accuracy turret punch press machines make it necessary to periodically adjust positions of the turrets and other parts.

SUMMARY OF THE INVENTION

The present invention is therefore intended to eliminate the above-mentioned disadvantages. The object of the present invention is to provide a turret punch press machine capable of preventing the positional relationship of die halves from coming out of order because of the frame deformation, making it possible to achieve high accuracy processing on even a thin work, prolonging the lifetime of dies, and making it unnecessary to positionally adjust turrets and the like.

According to the present invention, there is provided a turret punch press machine comprising a frame consisting of a base frame portion, column portions erected upward from the base frame portion, and an upper frame portion extended horizontally from the column portions; upper and lower turrets each provided with plural die halves at its circumferential rim portion; a hammer for pressing the dies; and a hammer driving mechanism, wherein at least the upper frame portion is divided into first and second upper frame portions, the hammer and the hammer driving mechanism are attached to the first upper frame portion, and the upper turret is attached to the second upper frame portion while the lower turret is attached to the base frame portion. Even when the first upper frame portion is deformed because of the repulsive force of the hammer which is being operated, therefore, the second upper frame portion is left undeformed, so that the positional relationship between the upper and lower turrets can be kept unchanged. Further, the second upper frame portion is held undeformed, despite of the heat and aging deformation of the first upper frame, so that the positional relationship between the die halves can be kept higher in accuracy.

Brief Description of the Drawing

The present invention will become apparent from the following detailed description made about some embodiments with reference to the accompanying drawings.

DETAILED DESCRIPTION OF THE PREFERRED EMBODIMENT

Figure 1:
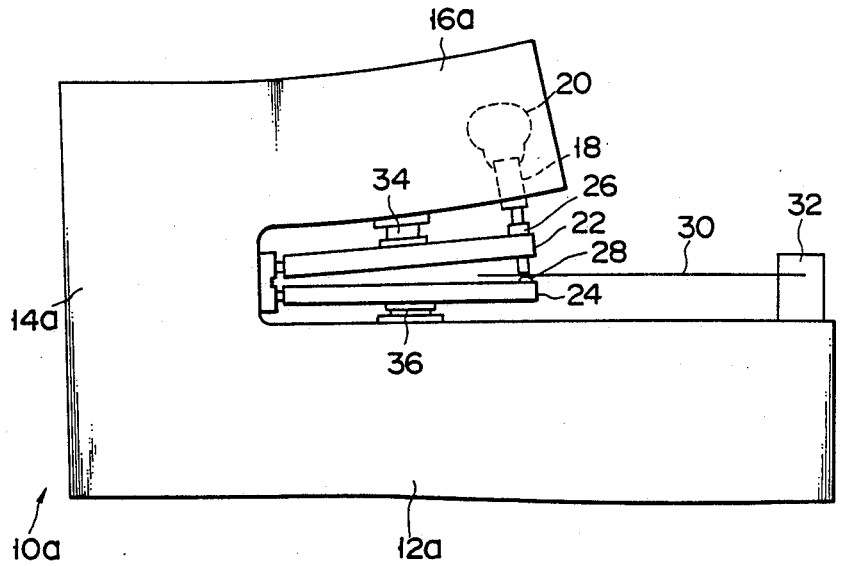
FIG. 1 (PRIOR ART)
FIG. 1 is a front view showing the conventional press machine provided with the C-shaped frame.
Figure 2:
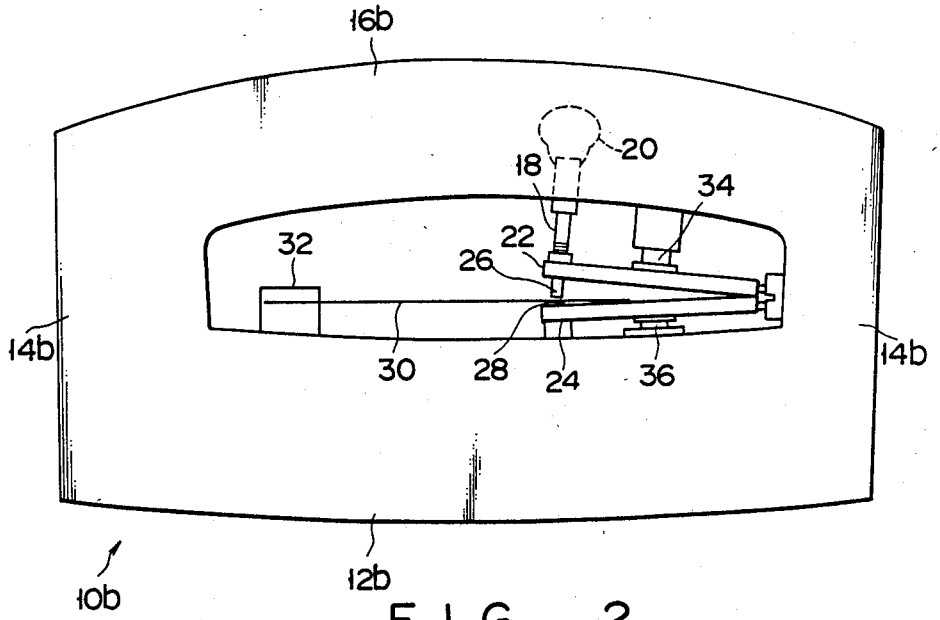
FIG. 2 (PRIOR ART)
FIG. 2 is a front view showing the conventional press machine provided with the gate-shaped frame.
Figure 3:
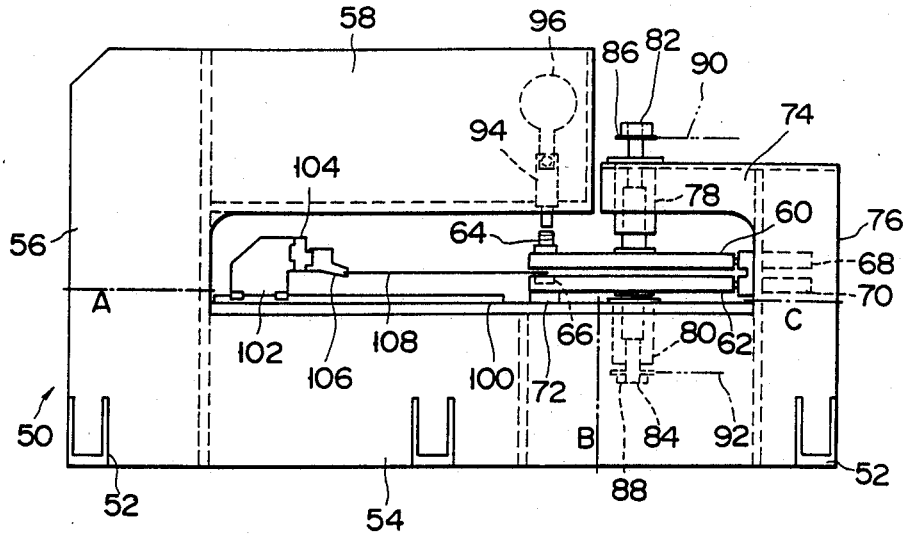
FIG. 3 is a front view showing a first example of the press machine provided with the C-shaped frame according to the present invention.
Figure 4:
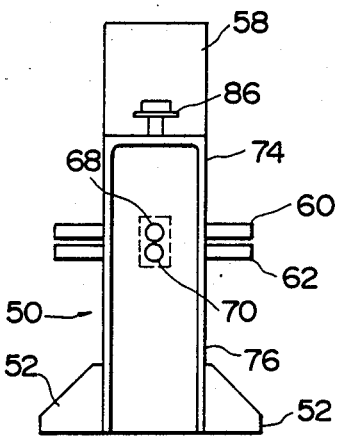
FIG. 4 is a right side view showing the press machine in FIG. 3.
Figure 5:
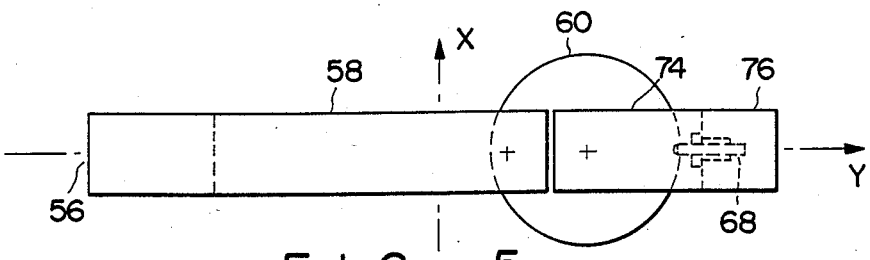
FIG. 5 is a plan showing the press machine in FIG. 3.

FIGS. 3 through 5 show a first example of the turret punch press machine according to the present invention. The press machine has a C-shaped frame. Numeral 50 represents the frame which is made by welding die steels and which is installed on the floor by means of brackets 52. The frame is provided with a base frame portion 54, from one end of which a first column portion 56 extends upward. A first upper frame portion 58 horizontally extends from the upper end of the first column portion 56. A second column portion 76 extends upward from the other end of the base frame portion 54. A second upper frame portion 74 is horizontally extended from the upper end of the second column portion 76. The first upper frame portion 58 and the second upper frame portion 74 oppose, face to face, a clearance interposed between their front ends.

The press machine is provided with a pair of upper and lower disc-like turrets 60 and 62, which have plural upper and lower die halves 64 and 66 attached to their circumferential rim portion, respectively. The upper turret 60 is rotatably attached to the front end portion of the second upper frame portion 74 by means of a shaft 82 and a bearing 78. The lower turret 62 is also rotatably attached to the base frame portion 54 by means of a shaft 84 and a bearing 80. Sprockets 86 and 88 are attached to the shafts 82 and 84, respectively, and connected to the well-known rotation drive mechanisms (not shown) by means of chains 90 and 92. Shot pin mechanisms 68 and 70 are arranged in the second column portion 76, thereby defining the rotating position of the turrets.

A hammer 94 and a hammer driving mechanism 96 are attached to the front end portion of the first upper frame portion 58. For driving the hammer, a conventional mechanism such as, for example, a mechanism for converting rotation of a drive shaft to a reciprocating movement for hammer 94 via a crank and crank arm, or a mechanism for reciprocating the hammer 94 by oil pressure, or the like, may be used. A hammer holder 72 is arranged on the base frame portion 54, opposing to the hammer 94.

Rails 100 are extended in a direction Y on the upper surface of the base frame portion 54 and a truck 102 is mounted on the rails 100 to freely move in the direction Y. Another truck 104 is mounted on the truck 102 to freely move in a direction X. A clamp 106 is attached to the truck 104 to clamp a work 108.

In press apparatus generally, the horizontal direction in which a work piece is inserted is the "X" direction, and the horizontal direction perpendicular to the X direction is called the "Y" direction.

In the case of the first example having such an arrangement as described above, the turrets move, thus moving the upper and lower halves of a selected die between the hammer 94 and the hammer holder 72. These die halves are positioned with accuracy by the shot pin mechanisms 68 and 70. The trucks then move, thus locating the work 108 at a predetermined position. The hammer 94 is pushed down by the hammer driving mechanism 96 and the upper die half 64 is thus pressed by the hammer to punch the work.

Even when the first upper frame portion 58 is deformed, in this case, by the repulsive force of the hammer which is being operated, the second upper frame portion 74 is not deformed. Therefore, the upper and lower turrets 60 and 62 do not come out of order in their positional relationship, thereby applying no influence to the accuracy of positioning the die halves. Further, a clearance is formed between the first 58 and the second upper frame portion 74. The heat created by the hammer driving mechanism 96, therefore, is not transmitted to the second upper frame 74. Thus, the second upper frame 74 can be free of heat deformation. Furthermore, the hammer 94 may not be positioned with a sufficiently high accuracy. Therefore, it is unnecessary to add to the first upper frame portion 58 a rigidity higher than required, thereby enabling the frame to be simplified in its construction.

Figure 6:
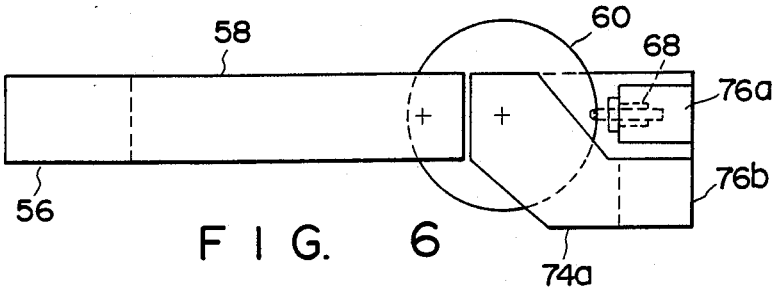
FIGS. 6 through 8 are plans showing variations of the frame employed by the press machine shown in FIG. 3.
Figure 7:
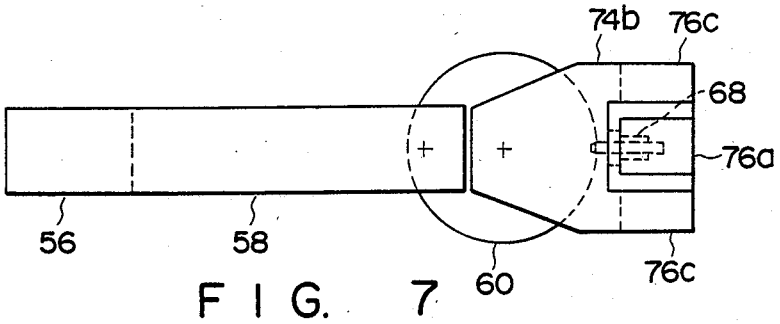
Figure 8:
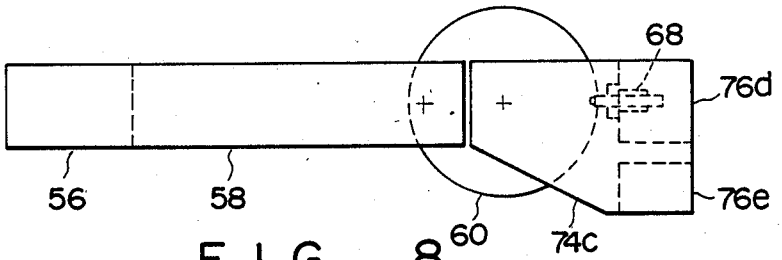

The second column and upper frame portions may not necessarily be shaped as shown in FIG. 5 but they can be modified variously as shown in FIGS. 6 through 8. As shown in FIG. 6, it may be arranged that a third column portion 76*b* extends beside a second column portion 76*a*, and that a second upper frame portion 74*a* horizontally extends from the upper end of the third column portion. When arranged like this, they can raise the accuracy of positioning the turrets.

As shown in FIG. 7, it may also be arranged that third and fourth column portions 76*c* are provided on both sides of the second column portion 76*a*, and that a second upper frame portion 74*b* horizontally extends from the upper ends of the third and fourth column portions.

As shown in FIG. 8, it may also be arranged that a third column portion 76*e* extends beside a second column portion 76*d*, and that a second upper frame portion 74c horizontally extends from the upper ends of the second and third column portions.

Figure 9:
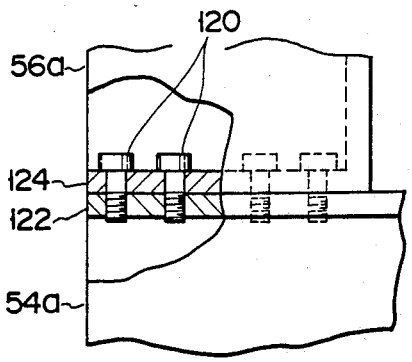
FIG. 9 is a partly-sectioned view showing the construction of divided portions at a section A of the press machine shown in FIG. 3.

The frame in the first example may be separated at all or some of the sections A, B and C shown in FIG. 3 or in all the examples, as set forth below. When the frame is arranged like this, it can be more easily made, and transportation and installation of the press machine can become easier as well. FIG. 9 shows an arrangement of connection at the section A of the frame. Flanges 122 and 124 extend from the base frame portion 54a and the first column portion 56a, respectively, and are connected to each other by means of plural bolts 120.

Figure 10:
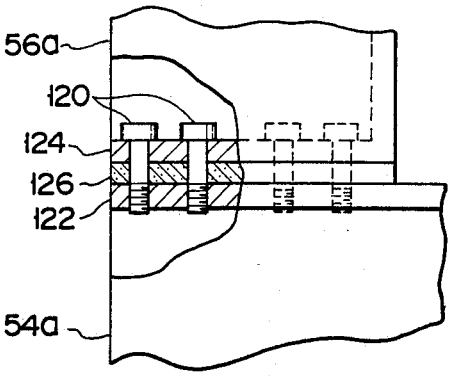
FIG. 10 is a partly-sectioned view showing another arrangement of connection at the section A of the press machine shown in FIG. 3.

FIG. 10 shows another arrangement of connection at the section A. An adiabatic plate 126 is interposed between the flanges 122 and 124 shown in FIG. 9. Heat caused by the hammer driving mechanism is intercepted by the adiabatic plate, and is not transmitted to the base frame portion 54a. The base frame portion can therefore be left free of heat deformation.

Figure 11:
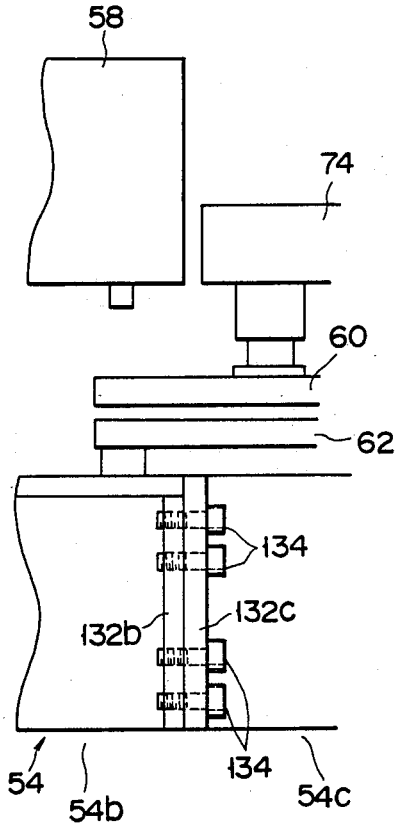
FIG. 11 is a front view showing an arrangement of connection at a section B of the press machine shown in FIG. 3.

FIG. 11 shows an arrangement of connection at the section B shown in FIG. 3. The base frame portion 54 is divided into first and second base frame portions 54b and 54c. Flanges 132b and 132c extend from those ends of the base frame portions 54b and 54c, respectively, which oppose to each other, and they are connected to each other by means of plural bolts 134.

Figure 12:
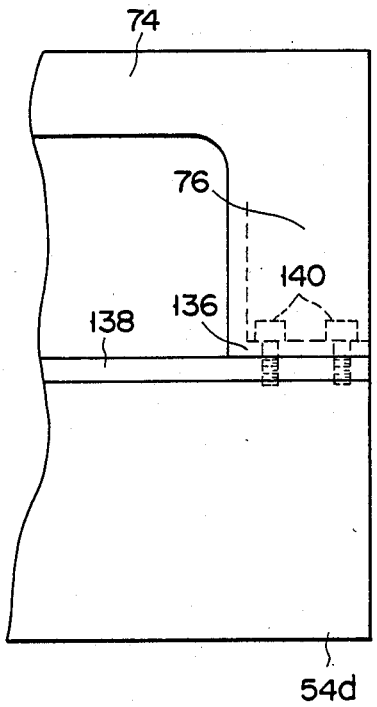
FIG. 12 is a front view showing an arrangement of connection at a section C of the press machine shown in FIG. 3.

FIG. 12 shows an arrangement of connection at the section C shown in FIG. 3. Flanges 136 and 138 extend from the base frame portion 54a and the second column portion 76 and are connected to each other by means of plural bolts 140. At the connection portion of the sections B and C, use can be made of an adiabatic material as in the case of the aforementioned section A.

Figure 13:
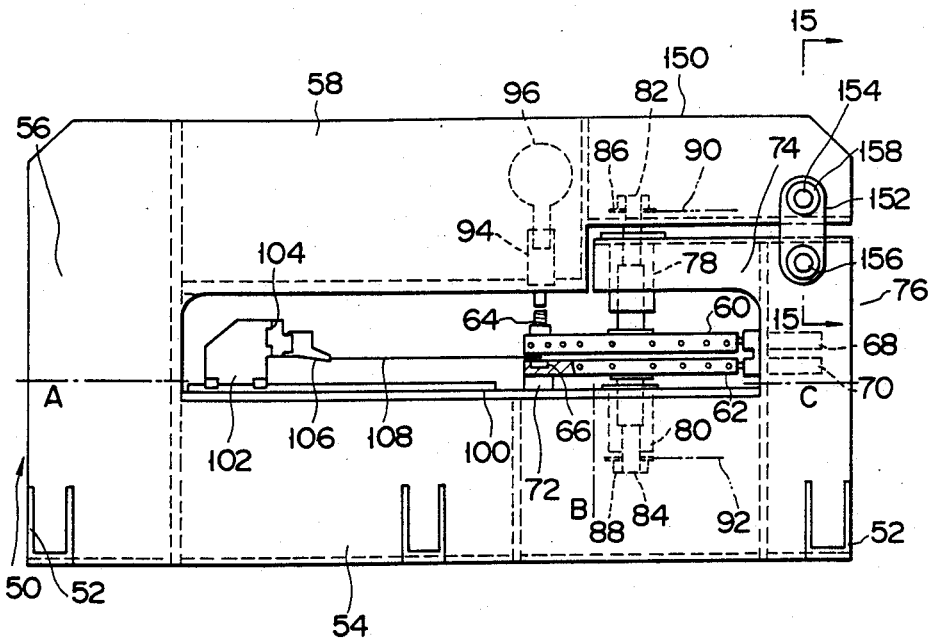
FIG. 13 is a front view showing a second example of the press machine provided with the gate-shaped frame according to the present invention.
Figure 14:
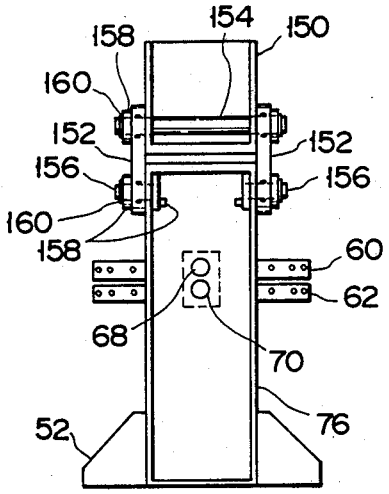
FIG. 14 is a right side view showing the press machine in FIG. 13.
Figure 15:
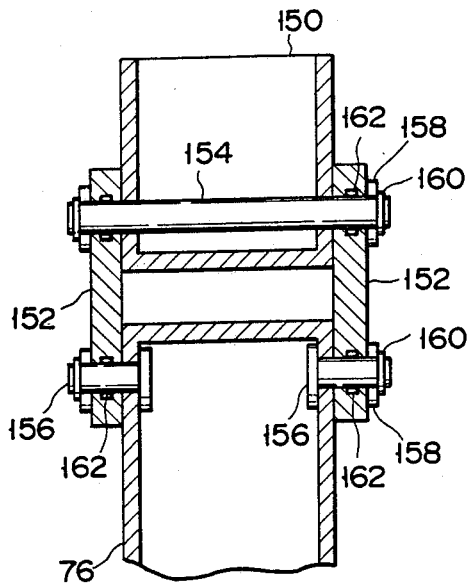
FIG. 15 is a sectional view taken along a line 15—15 in FIG. 13 and showing an arrangement of connection.

FIGS. 13 through 15 show a second example of the turret punch press machine provided with the gate-shaped frame according to the present invention. In the case of this press machine, a frame portion 150 extends from the front end of the first upper frame portion 58. The frame portion 150 is positioned above the second upper frame portion 74, with its front end aligned with the outer side of the second column portion 76. A clearance is provided between the frame portion 150 and the upper face of the second upper frame portion 74. The front end of the frame portion 150 is connected to the upper end of the second column portion 76 by means of a link mechanism. The link mechanism includes a pair of links 152 arranged along both sides of the frame portion 150 and of the second column portion 76. These links 152 are freely rotatably connected, at their both ends, to the front end of the frame portion 150 and the upper end of the second column portion 76, respectively, by means of rods 154 and 156. The rods 154 and 156 are held and do not come out of their through-holes by means of washers 158 and stoppers 160. Each of through-holes in the links 152 is provided with a groove in the inner face thereof, and a ring-like damping member 162 made of resilient material is embedded in the groove. The links can, therefore, be held not loose around the rods.

In the case of this second example of the press machine, the frame is substantially gate-shaped and this gate-shaped frame is stronger in construction, so that it can be less deformed by the hammer which is being operated. Since the frame portion 150 and the second column portion 76 are connected to each other by means of the link mechanism, they are allowed to relatively move in the horizontal direction. Therefore, only a pulling force acts on the second column portion 76 in the vertical direction while the hammer is being operated. The second column portion 76 can thus be left undeformed. The second upper frame portion is not deformed, either. The accuracy of positioning the turrets can be held, accordingly. The frame portion 150 and the second upper frame portion 74 have a clearance between them, so that heat created by the hammer driving mechanism cannot be transmitted to the second upper frame portion. In this example, the frame may be divided at the aforementioned respective position of the sections A, B and C, as set forth above.

Figure 16:
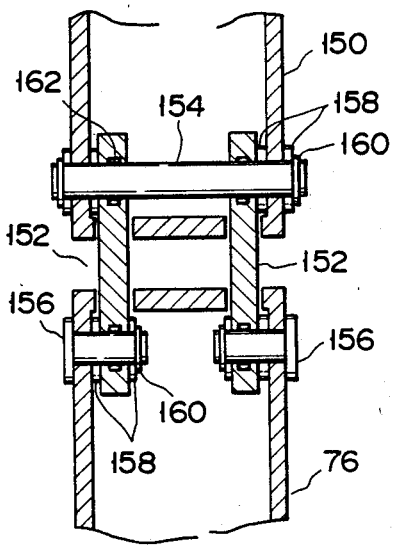
FIG. 16 is a sectional view similar to FIG. 15 showing another arrangement of connection.

FIG. 16 shows another link mechanism wherein the links 152 are arranged within the frame portion 150 and the second column portion 76. Except for this, the arrangement shown in FIG. 16 is same as that shown in FIG. 15.

Figure 17:
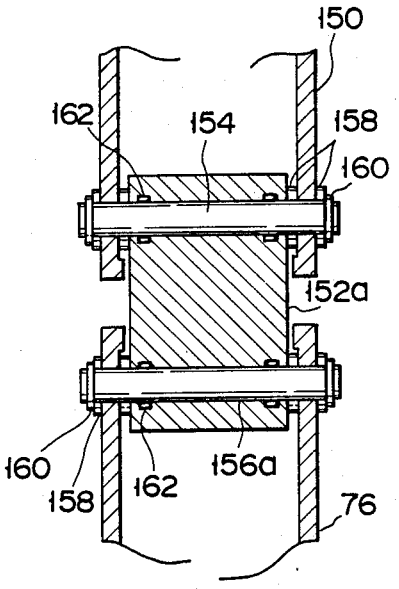
FIG. 17 is a sectional view similar to FIG. 15 showing a further arrangement of connection.

FIG. 17 shows a further link mechanism wherein a wide link 152a is arranged inside the frame portion 150 and the second column portion 76 to connect them through rods 154 and 156a. Except for this point, the arrangement shown in FIG. 17 is the same as that shown in FIG. 16.

Figure 18:
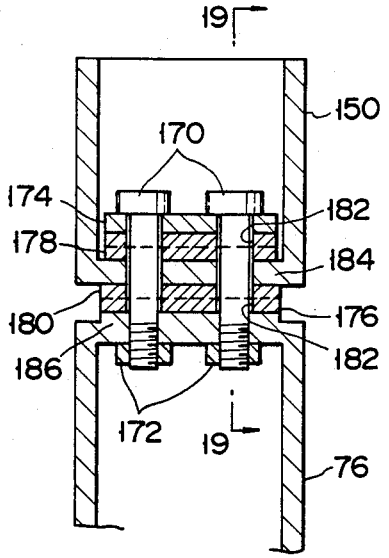
FIG. 18 is a sectional view similar to FIG. 15 showing a still further arrangement of connection.
Figure 19:
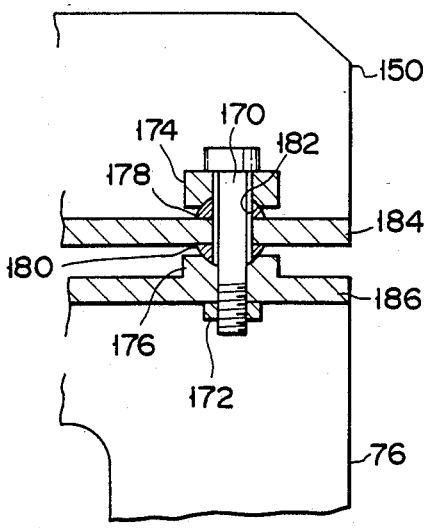
FIG. 19 is a sectional view taken along a line 19—19 in FIG. 18.
Figure 20:
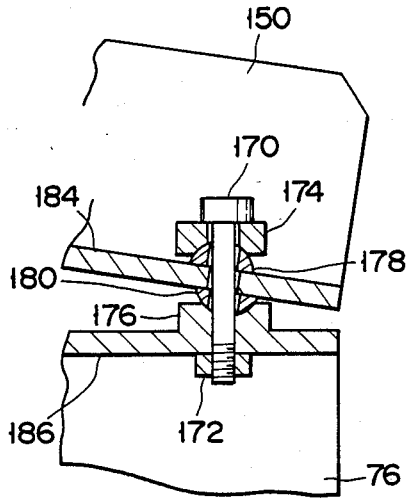
FIG. 20 is a sectional view similar to FIG. 19 showing the frame deformed.

FIGS. 18 through 20 show still further arrangements of connection between the frame portion 150 and the second column portion 76. Flanges 184 and 186 are formed on the front and upper ends of the frame portion 150 and the second column portion 76, and are connected to each other by means of bolts 170 passing through the flanges and by means of nuts 172. A pair of members 178 and 180, each semicircular in section and shaped in such a way that a cylinder is divided into halves which extend along a plane including the axis of the cylinder, are arranged between the head of the bolt 170 and the nut 172. Each of them has a through-hole 182 through which the bolt is passed. Seats 174 and 176 are arranged between the head of the bolt and the semicircular member and between the semicircular member and the nut, and each of the seats has a groove semicircular in section to receive the semicircular member.

The frame portion 150 and the second column portion 76 are connected to each other by the bolts 170 and nuts 172 to form the substantially gate-shaped frame. Even when the first frame portion is deformed and the frame portion 150 is slanted, the semicircular members and the seats are slid with one another, as shown in FIG. 20, to absorb the slant of the frame portion 150.

Figure 21:
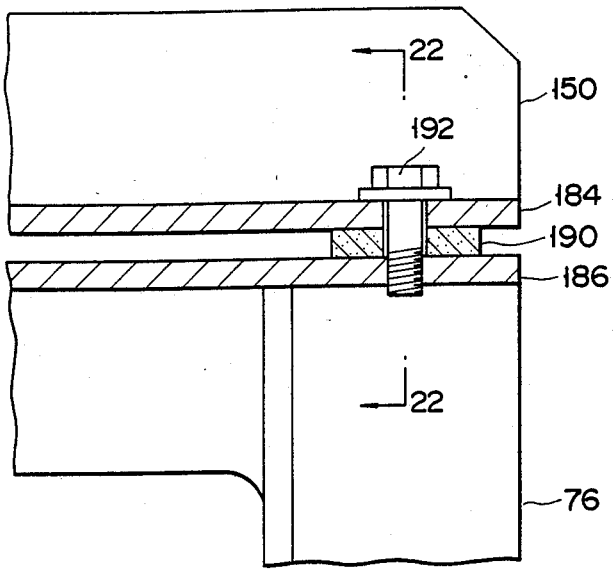
FIG. 21 is a sectional view showing a still further arrangement of connection.
Figure 22:
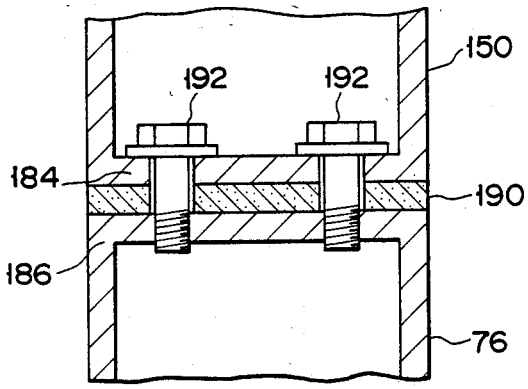
FIG. 22 is a sectional view taken along a line 22—22 in FIG. 21.

FIGS. 21 and 22 show another arrangement of connection between the frame portion 150 and the second column portion 76. The flange 184 of the frame portion 150 and that 186 of the second column portion 76 are connected to each other by plural bolts 192, sandwiching a plate-like or preferably an anti-impact adiabatic material 190 between them. When the flanges 184 and 186 slide relative to each other, the shift of the frame portion 150 in the horizontal direction can be absorbed. In addition, the adiabatic material can prevent heat created by the hammer driving mechanism from being transmitted to the second column portion 76.

Figure 23:
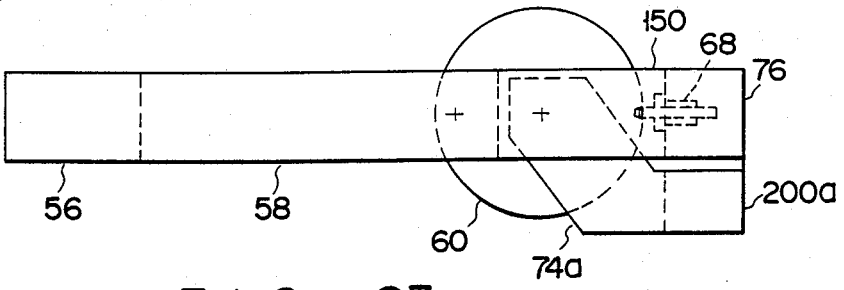
FIGS. 23 through 25 are plans showing variations of the gate-shaped frame.
Figure 24:
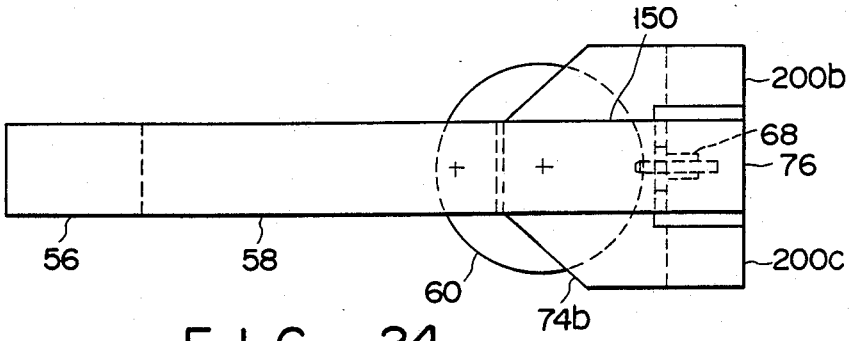
Figure 25:
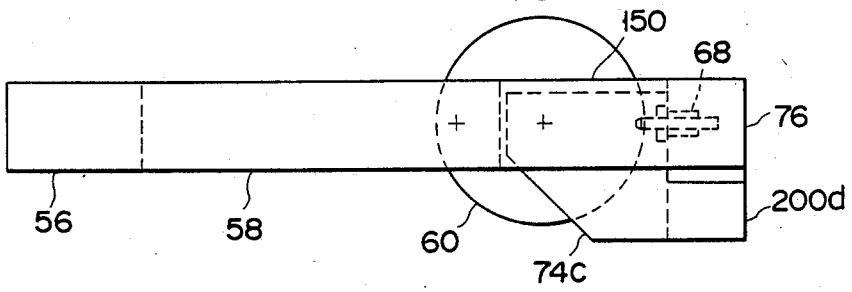

FIGS. 23 through 25 are plans showing modifications of the frame in the case of the press machine provided with the gate-shaped frame shown in FIG. 13.

In FIG. 23, a third column portion 200a is provided beside the second column portion 76, and the second upper frame portion 74a extends from the upper end of the third column portion 200a. This has an advantage that the third column portion 200a and the second upper frame portion 74a can be left not influenced by the repulsive force and the like of the hammer which is being operated. In addition, the front end of frame portion 150 and the upper end of the second column portion 76 can be connected integral by welding or by using such arrangements of connection as are shown in FIGS. 15 through 22.

FIG. 24 shows another arrangement of the frame wherein third and fourth column portions **200*b* and 200*c* are provided on both sides of the second column portion 76, and a second upper frame portion 74*b* horizontally extends from the upper ends of the column portions 200*b* and 200*c*. The front end of the frame portion 150 can be connected to the upper end of the second column portion 76 by welding or the like, as in the case shown in FIG. 23**.

FIG. 25 shows a further arrangement of the frame wherein a third column portion **200*d* is provided beside the second column portion 76, and a second upper frame portion 74*c* horizontally extends from the upper ends of the third and second column portions 200*d* and 76**. The frame can be made stronger in construction.

It should be understood that the present invention is not limited to the above-described embodiments and that various changes and modifications can be made by those skilled in the art without departing from the spirit and scope of the present invention.

What is claimed is:

1. A turret punch press machine comprising:

a frame including:

a base frame portion;

column portions provided on said base frame portion, said column portions having upper ends; and an upper frame portion substantially horizontally extending from the upper ends of said column portions;

said upper frame portion comprising at least a first upper frame portion and a second upper frame portion, said first and second upper frame portions being separate and structurally independent of each other so that one of said first and second upper frame portions is not deformed upon deformation of the other of said first and second upper frame portions;

a pair of upper and lower turrets each having plural die halves at circumferential rim portions thereof, said upper turret being mounted to said second upper frame portion, and said lower turret being mounted to said base frame portion;

hammer means mounted to said first upper frame portion for striking the die halves downward; and a hammer driving mechanism mounted to said first upper frame portion for driving said hammer means.

2. A turret punch press machine according to claim 1, wherein a first column portion extends from one end of the base frame portion, and the first upper frame portion horizontally extends from the upper end of the first column portion, whereas a second column portion extends from another end of the base frame portion, and the second upper frame portion horizontally extends from the upper end of the second column portion, and the first and second upper frame portions are opposed to each other with a clearance interposed between them.

3. A turret punch press machine according to claim 2 wherein a front end of the first upper frame portion extends above the second column portion, and this front end of the first upper frame portion is connected to the upper end of the second column portion.

4. A turret punch press machine according to claim 3, further comprising:

a first flange on a front end of said first upper frame portion, and a second flange on an upper end of said second column portion, said first and second flanges being separated and facing toward each other in the vertical direction, said first and second flanges having associated first and second semi-cylindrical members and first and second seat members, each of said seat members having a groove corresponding to a cylindrical surface of one of said semi-cylindrical members, said first semi-cylindrical member abutting an upper surface of said first flange with the cylindrical surface of the member facing upwardly, said first seat member being mountable on the first semi-cylindrical member so that the groove of the first seat member engages the cylindrical surface of said first semi-cylindrical member, said second semi-cylindrical member abutting a lower surface of said first flange with the cylindrical surface of the member facing downwardly, said second seat member being arranged between the second semi-cylindrical member and said second flange so that the groove of the second seat member engages the cylindrical surface of said second semi-cylindrical member, bolt means for connecting through aligned openings in said flanges, the cylindrical members, and said seat members, and nut means engageable with said bolt means for tightening said flanges, the semi-cylindrical members, and said seat members when said nut means is tightened on said bolt means, for connecting the front end of said first upper frame portion to the upper end of said second column portion.

5. A turret punch press machine according to claim 3, wherein the front end of the first upper frame portion and the upper end of the second column portion are connected to each other by means of a link mechanism in such that they are movable relative to each other in the horizontal direction.

6. A turret punch press machine according to claim 3, wherein an adiabatic material is interposed between a front end of the first upper frame portion and the upper end of the second column portion.

7. A turret punch press machine according to claim 1, wherein said base frame portion is further divided into a plurality of sub-portions, said sub-portions forming said base frame portion and arranged to be detachably connected to one another, and said lower turret is mounted on one of said sub-portions.

8. A turret punch press machine comprising:

a frame including:

a base frame portion, said base frame portion having ends;

column portions provided on said base frame portion, said column portions having upper ends; and an upper frame portion substantially horizontally extending from the upper ends of said column portions;

said upper frame portion comprising at least a first upper frame portion and a second upper frame portion which are opposed to each other with a clearance interposed between them;

a pair of upper and lower turrets each having plural die halves at circumferential rim portions thereof, said upper turret being mounted to said second upper frame portion, and said lower turret being mounted to said base frame portion;

hammer means mounted to said first upper frame portion for striking the die halves downward; and a hammer driving mechanism mounted to said first upper frame portion for driving said hammer means;

said column portions including a first column portion extending from one end of said base frame portion, and said first upper frame portion horizontally extending from the upper end of said first column portion; and a second column portion extending from another end of said base frame portion, and said second upper frame portion horizontally extending from the upper end of said second column portion.

9. A turret punch press machine according to claim 8, wherein a front end of said first upper frame portion extends above the second column portion, and said front end of said first upper frame portion is connected to the upper end of said second column portion.

10. A turret punch press machine according to claim 9, wherein said front end of said first upper frame portion and said upper end of said second column portion are connected to each other by means of a link mechanism such that they are movable relative to each other in the horizontal direction.

11. A turret punch press machine according to claim 9, wherein an adiabatic material is interposed between a front end of said first upper frame portion and the upper end of said second column portion.

* * * * *